US008635871B2

(12) United States Patent
Ernst et al.

(10) Patent No.: US 8,635,871 B2
(45) Date of Patent: Jan. 28, 2014

(54) WASTE HEAT RECOVERY SYSTEM WITH CONSTANT POWER OUTPUT

(71) Applicant: Cummins Inc., Columbus, IN (US)

(72) Inventors: Timothy C. Ernst, Columbus, IN (US); Christopher R. Nelson, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 13/756,263

(22) Filed: Jan. 31, 2013

(65) Prior Publication Data

US 2013/0139506 A1 Jun. 6, 2013

Related U.S. Application Data

(60) Continuation of application No. 12/958,101, filed on Dec. 1, 2010, now Pat. No. 8,407,998, which is a division of application No. 12/152,088, filed on May 12, 2008, now Pat. No. 7,866,157.

(51) Int. Cl.

| | |
|---|---|
| ***F01K 23/10*** | (2006.01) |
| ***F02G 3/00*** | (2006.01) |
| ***F01N 3/02*** | (2006.01) |
| ***F01N 5/02*** | (2006.01) |

(52) U.S. Cl.
USPC ..... 60/618; 60/320; 60/616

(58) Field of Classification Search
USPC ..... 60/278, 320, 321, 614–624; 123/568.11–568.32
See application file for complete search history.

(56) References Cited

U.S. PATENT DOCUMENTS

| | | | |
|---|---|---|---|
| 3,232,052 | A | 2/1966 | Ricard |
| 3,789,804 | A | 2/1974 | Aguet |
| 4,009,587 | A | 3/1977 | Robinson, Jr. et al. |
| 4,164,850 | A | 8/1979 | Lowi, Jr. |
| 4,204,401 | A | 5/1980 | Earnest |
| 4,232,522 | A | 11/1980 | Steiger |
| 4,267,692 | A | 5/1981 | Earnest |
| 4,271,664 | A | 6/1981 | Earnest |
| 4,428,190 | A | 1/1984 | Bronicki |
| 4,458,493 | A | 7/1984 | Amir et al. |
| 4,581,897 | A | 4/1986 | Sankrithi |
| 4,630,572 | A | 12/1986 | Evans |
| 4,831,817 | A | 5/1989 | Linhardt |
| 4,873,829 | A | 10/1989 | Williamson |
| 4,911,110 | A | 3/1990 | Isoda et al. |
| 5,121,607 | A | 6/1992 | George, Jr. |
| 5,207,188 | A | 5/1993 | Hama et al. |

(Continued)

FOREIGN PATENT DOCUMENTS

| | | | |
|---|---|---|---|
| EP | 1 273 785 | B1 | 5/2007 |
| JP | 60-222511 | A | 11/1985 |

(Continued)

*Primary Examiner* — Christopher Jetton
(74) *Attorney, Agent, or Firm* — Foley & Lardner LLP

(57) ABSTRACT

A waste heat recovery system for use with an engine. The waste heat recovery system receives heat input from both an exhaust gas recovery system and exhaust gas streams. The system includes a first loop and a second loop. The first loop is configured to receive heat from both the exhaust gas recovery system and the exhaust system as necessary. The second loop receives heat from the first loop and the exhaust gas recovery system. The second loop converts the heat energy into electrical energy through the use of a turbine.

10 Claims, 3 Drawing Sheets

(56) References Cited

U.S. PATENT DOCUMENTS

| | | | | |
|---|---|---|---|---|
| 5,421,157 | A | 6/1995 | Rosenblatt | |
| 5,649,513 | A | 7/1997 | Kanda | |
| 5,685,152 | A | 11/1997 | Sterling | |
| 5,771,868 | A | 6/1998 | Khair | |
| 5,806,322 | A | 9/1998 | Cakmakci et al. | |
| 5,915,472 | A | 6/1999 | Takikawa et al. | |
| 5,950,425 | A | 9/1999 | Takahashi et al. | |
| 6,014,856 | A | 1/2000 | Bronicki et al. | |
| 6,035,643 | A | 3/2000 | Rosenblatt | |
| 6,055,959 | A | 5/2000 | Taue | |
| 6,128,905 | A | 10/2000 | Fahlsing | |
| 6,138,649 | A | 10/2000 | Khair et al. | |
| 6,286,312 | B1 * | 9/2001 | Bertilsson | 60/605.2 |
| 6,301,890 | B1 | 10/2001 | Zeretzke | |
| 6,321,697 | B1 | 11/2001 | Matsuda et al. | |
| 6,324,849 | B1 | 12/2001 | Togawa et al. | |
| 6,393,840 | B1 | 5/2002 | Hay | |
| 6,494,045 | B2 | 12/2002 | Rollins, III | |
| 6,523,349 | B2 | 2/2003 | Viteri | |
| 6,571,548 | B1 | 6/2003 | Bronicki et al. | |
| 6,598,397 | B2 | 7/2003 | Hanna et al. | |
| 6,606,848 | B1 | 8/2003 | Rollins, III | |
| 6,637,207 | B2 | 10/2003 | Konezciny et al. | |
| 6,701,712 | B2 | 3/2004 | Bronicki et al. | |
| 6,715,296 | B2 | 4/2004 | Bakran et al. | |
| 6,745,574 | B1 | 6/2004 | Dettmer | |
| 6,748,934 | B2 | 6/2004 | Natkin et al. | |
| 6,751,959 | B1 | 6/2004 | McClanahan et al. | |
| 6,792,756 | B2 | 9/2004 | Bakran et al. | |
| 6,810,668 | B2 | 11/2004 | Nagatani et al. | |
| 6,817,185 | B2 | 11/2004 | Coney et al. | |
| 6,848,259 | B2 | 2/2005 | Keller-Sornig et al. | |
| 6,877,323 | B2 | 4/2005 | Dewis | |
| 6,880,344 | B2 | 4/2005 | Radcliff et al. | |
| 6,910,333 | B2 | 6/2005 | Minemi et al. | |
| 6,964,168 | B1 | 11/2005 | Pierson et al. | |
| 6,977,983 | B2 | 12/2005 | Correia et al. | |
| 6,986,251 | B2 | 1/2006 | Radcliff et al. | |
| 7,007,487 | B2 | 3/2006 | Belokon et al. | |
| 7,028,463 | B2 | 4/2006 | Hammond et al. | |
| 7,044,210 | B2 | 5/2006 | Usui | |
| 7,069,884 | B2 | 7/2006 | Baba et al. | |
| 7,117,827 | B1 | 10/2006 | Hinderks | |
| 7,121,906 | B2 | 10/2006 | Sundel | |
| 7,131,259 | B2 | 11/2006 | Rollins, III | |
| 7,131,290 | B2 | 11/2006 | Taniguchi et al. | |
| 7,159,400 | B2 | 1/2007 | Tsutsui et al. | |
| 7,174,716 | B2 | 2/2007 | Brasz et al. | |
| 7,174,732 | B2 | 2/2007 | Taniguchi et al. | |
| 7,191,740 | B2 | 3/2007 | Baba et al. | |
| 7,200,996 | B2 | 4/2007 | Cogswell et al. | |
| 7,225,621 | B2 | 6/2007 | Zimron et al. | |
| 7,281,530 | B2 | 10/2007 | Usui | |
| 7,325,401 | B1 | 2/2008 | Kesseli et al. | |
| 7,340,897 | B2 | 3/2008 | Zimron et al. | |
| 7,454,911 | B2 | 11/2008 | Tafas | |
| 7,469,540 | B1 | 12/2008 | Knapton et al. | |
| 7,578,139 | B2 | 8/2009 | Nishikawa et al. | |
| 7,665,304 | B2 | 2/2010 | Sundel | |
| 7,721,552 | B2 | 5/2010 | Hansson et al. | |
| 7,797,940 | B2 | 9/2010 | Kaplan | |
| 7,823,381 | B2 | 11/2010 | Misselhorn | |
| 7,833,433 | B2 | 11/2010 | Singh et al. | |
| 7,866,157 | B2 | 1/2011 | Ernst et al. | |
| 7,942,001 | B2 | 5/2011 | Radcliff et al. | |
| 7,958,873 | B2 | 6/2011 | Ernst et al. | |
| 7,997,076 | B2 | 8/2011 | Ernst | |
| 2002/0099476 | A1 | 7/2002 | Hamrin et al. | |
| 2003/0033812 | A1 | 2/2003 | Gerdes et al. | |
| 2003/0213245 | A1 | 11/2003 | Yates et al. | |
| 2003/0213246 | A1 | 11/2003 | Coll et al. | |
| 2003/0213248 | A1 | 11/2003 | Osborne et al. | |
| 2005/0262842 | A1 | 12/2005 | Claassen et al. | |
| 2008/0289313 | A1 | 11/2008 | Batscha et al. | |
| 2009/0031724 | A1 | 2/2009 | Ruiz | |
| 2009/0090109 | A1 | 4/2009 | Mills et al. | |
| 2009/0121495 | A1 | 5/2009 | Mills | |
| 2009/0133646 | A1 | 5/2009 | Wankhede et al. | |
| 2009/0151356 | A1 | 6/2009 | Ast et al. | |
| 2009/0179429 | A1 | 7/2009 | Ellis et al. | |
| 2009/0211253 | A1 | 8/2009 | Radcliff et al. | |
| 2009/0320477 | A1 | 12/2009 | Juchymenko | |
| 2009/0322089 | A1 | 12/2009 | Mills et al. | |
| 2010/0018207 | A1 | 1/2010 | Juchymenko | |
| 2010/0071368 | A1 | 3/2010 | Kaplan et al. | |
| 2010/0083919 | A1 | 4/2010 | Bucknell | |
| 2010/0139626 | A1 | 6/2010 | Raab et al. | |
| 2010/0180584 | A1 | 7/2010 | Berger et al. | |
| 2010/0192569 | A1 | 8/2010 | Ambros et al. | |
| 2010/0212304 | A1 * | 8/2010 | Hoetger | 60/320 |
| 2010/0229525 | A1 | 9/2010 | Mackay et al. | |
| 2010/0257858 | A1 | 10/2010 | Yaguchi et al. | |
| 2010/0263380 | A1 | 10/2010 | Biederman et al. | |
| 2010/0282221 | A1 | 11/2010 | Le Lievre | |
| 2010/0288571 | A1 | 11/2010 | Dewis et al. | |
| 2011/0005477 | A1 | 1/2011 | Terashima et al. | |
| 2011/0006523 | A1 | 1/2011 | Samuel | |
| 2011/0094485 | A1 | 4/2011 | Vuk et al. | |
| 2011/0209473 | A1 | 9/2011 | Fritz et al. | |
| 2012/0023946 | A1 | 2/2012 | Ernst et al. | |

FOREIGN PATENT DOCUMENTS

| | | | |
|---|---|---|---|
| JP | 8-68318 | A | 3/1996 |
| JP | 9-32653 | A | 2/1997 |
| JP | 10-238418 | A | 9/1998 |
| JP | 11-166453 | A | 6/1999 |
| JP | 2005-36787 | A | 2/2005 |
| JP | 2005-42618 | A | 2/2005 |
| JP | 2005-201067 | A | 7/2005 |
| JP | 2005-329843 | A | 12/2005 |
| JP | 2007-332853 | A | 12/2007 |
| JP | 2008-240613 | A | 10/2008 |
| JP | 2009-167995 | A | 7/2009 |
| JP | 2009-191647 | A | 8/2009 |
| JP | 2010-77964 | A | 4/2010 |
| WO | 2009/098471 | A2 | 8/2009 |

* cited by examiner

WASTE HEAT RECOVERY SYSTEM WITH CONSTANT POWER OUTPUT

FIELD OF THE INVENTION

The present invention generally relates to diesel engines and more particularly to a waste heat recovery system applied to a diesel engine.

BACKGROUND OF THE INVENTION

Various devices for generating electrical power from hot products of combustion are known, such as those described in U.S. Pat. Nos. 6,014,856, 6,494,045, 6,598,397, 6,606,848 and 7,131,259, for example.

SUMMARY OF THE INVENTION

An embodiment of the present invention relates to a heat recovery system for an engine including an exhaust and an exhaust gas recovery system. In embodiments of the invention, the heat recovery system includes a first loop and a second loop. The first loop includes fluid, a conduit, two heat exchangers and a valve. The first heat exchanger of the loop conducts heat energy between the fluid and the exhaust gas recovery system, and the second heat exchanger of the loop conducts heat energy between the fluid and the exhaust. The valve of the loop is configured to control the amount of fluid passing through the second heat exchanger of the loop.

In embodiments of the invention, the second loop includes a heat exchanger, fluid and a turbine. The heat exchanger of the second loop transfers heat from the exhaust gas recovery system to the fluid. The turbine converts heat from the fluid into electrical energy. In embodiments of the invention, the system further includes a heat exchanger configured to transfer heat from the first loop to the second loop.

In embodiments of the invention, the fluid of the second loop is at least partially an organic fluid. In embodiments of the invention, the fluid is at least partially pentane. In embodiments of the invention, the fluid is at least partially butane.

In embodiments of the invention, the heat exchanger configured to transfer heat form the first loop to the second loop is a boiler. In embodiments of the invention, the fluid in the second loop transitions from a liquid state to a gas state in the heat exchanger transferring heat from the exhaust gas recovery system to the fluid. In embodiments of the invention, the heat exchanger configured to transfer heat from the first loop to the second loop is located between the turbine and the heat exchanger transferring heat between the second loop and the exhaust gas recovery system.

In embodiments of the invention, the valve in the first loop controls the amount of liquid that passes through the heat exchanger configured to transfer heat between the exhaust and the loop.

An embodiment of the present invention relates to a heat recovery system configured for use with a diesel engine that includes an exhaust system and an exhaust gas recovery system configured for use in a high flow state and a low flow state. An embodiment of the heat recovery system includes a first loop including a fluid flowing through an outer loop portion and an inner loop portion. In embodiments of the invention, the outer loop portion includes a first heat exchanger thermally connected to the exhaust gas recovery system. In embodiments of the invention, the inner loop portion includes a second heat exchanger thermally connected to the exhaust system. In embodiments of the invention, a valve connects the inner loop portion to the outer loop portion.

In embodiments of the invention, the second loop includes a fluid, a pump, a condenser, a turbine and a third heat exchanger. The pump is configured to drive the fluid. The condenser is configured to condense the fluid from a gaseous state to a liquid state. The turbine is configured to convert heat energy in the fluid to electrical energy, and the third heat exchanger is configured to thermally connect the exhaust gas recovery system and the second loop.

In embodiments of the invention, a fourth heat exchanger thermally connects the first loop to the second loop.

An embodiment of the invention includes a method for generating power using waste heat from an engine including an exhaust system and an exhaust gas recovery system. The method includes the steps of transferring heat energy from the exhaust gas recovery system to a liquid flowing through conduit defining a first loop; transferring heat energy from the exhaust system to the liquid of the first loop; transferring heat energy from the exhaust gas recovery system to a liquid flowing through conduit defining a second loop; transferring heat energy from the liquid of the first loop to liquid of the second loop, and generating electrical power with a turbine with the heat energy stored in the liquid of the second loop.

The features and advantages of the present invention described above, as well as additional features and advantages, will be readily apparent to those skilled in the art upon reference to the following description and the accompanying drawing.

BRIEF DESCRIPTION OF THE DRAWINGS

The above-mentioned and other features of this invention and the manner of obtaining them will become more apparent and the invention itself will be better understood by reference to the following description of embodiments of the present invention taken in conjunction with the accompanying drawings, wherein.

Figure 1:
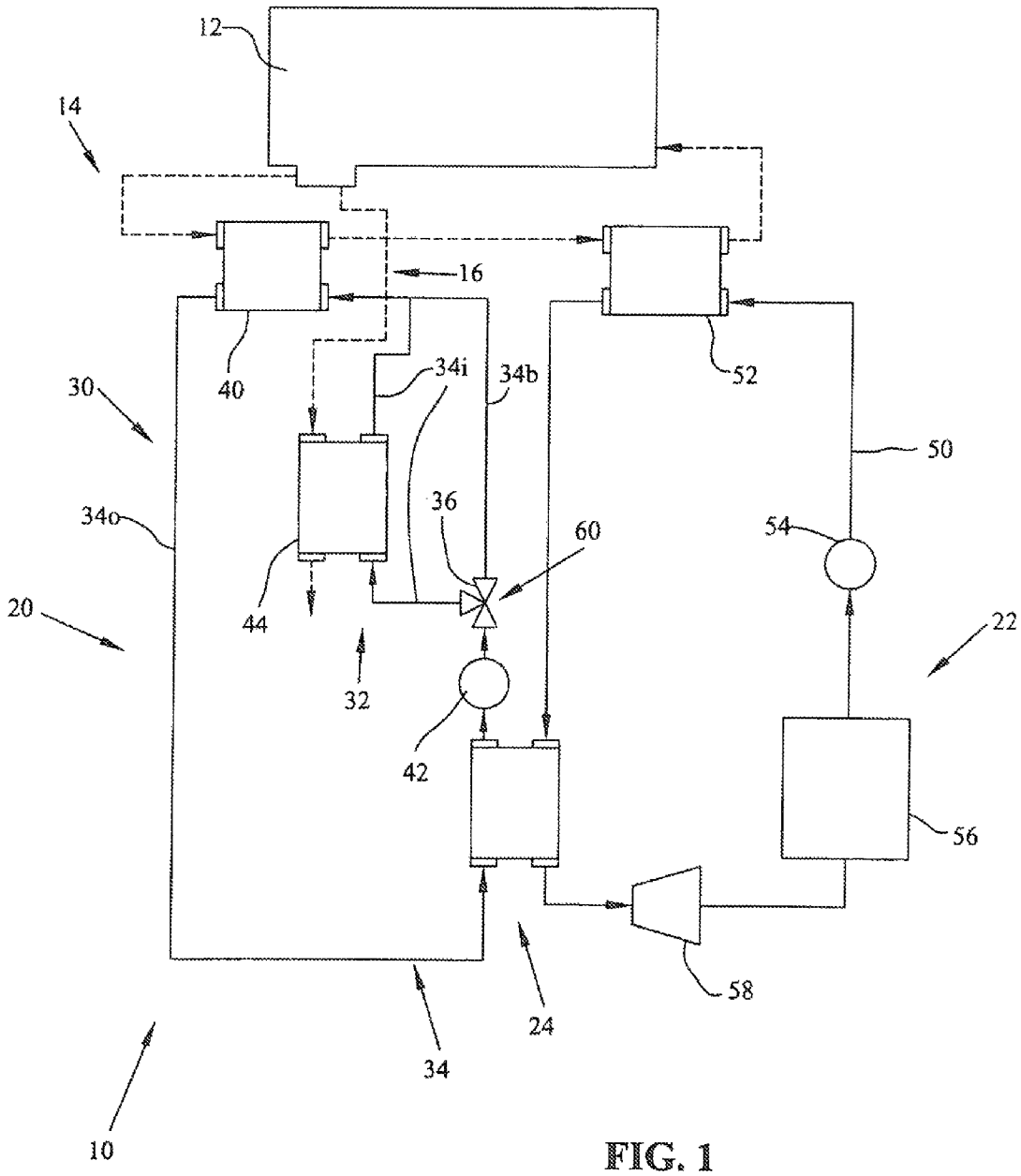
FIG. 1 depicts a general schematic diagram of portions of an exemplary waste heat recovery system embodying principles of the present invention.

Although the drawings represent embodiments of various features and components according to the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated device and described method and further applications of the principles of the invention, which would normally occur to one skilled in the art to which the invention relates.

Moreover, the embodiments were selected for description to enable one of ordinary skill in the art to practice the invention.

FIG. 1 depicts a portion of an exemplary waste heat recovery system, generally indicated by numeral 10. In the depicted embodiment, system 10 includes an engine 12. Engine 12 may be any type of suitable engine. For purposes of the following description, engine 12 represents a traditional diesel type engine.

In the depicted embodiment, diesel engine 12 includes an exhaust gas recirculation system, generally indicated by numeral 14 and an exhaust system, generally indicated by numeral 16. As should be understood by one with ordinary skill in the art, the exhaust gas recirculation system 14 is generally utilized in a diesel engine in order to reduce emissions of harmful byproducts produced in the process. Exhaust system 16 is utilized to expel exhaust gases from engine 12.

In the depicted embodiment, waste heat recovery system 10 includes a first loop, generally indicated by numeral 20, a second loop, generally indicated by numeral 22 and heat exchanger 24.

First loop 20 includes an outer loop, generally indicated by numeral 30, an inner loop, generally indicated by numeral 32, and a valve 36. In the depicted embodiment, the conduit indicated by 34*o* and 34*b* defines the outer loop 30.

Outer loop 30 includes a heat exchanger 40 and a pump 42, and outer loop 30 may be filled with any suitable type of fluid capable of conducting heat. Heat exchanger 40 may be any suitable type of heat exchanger known in the art. Pump 42 is configured to drive the fluid through the conduit 34*o* of the outer loop 30. In the depicted embodiment, heat exchanger 40 is configured to allow heat to transfer between the exhaust gas recovery system 14 and the fluid present within conduit 34*o* of outer loop 30.

In the depicted embodiment, conduit 34*i* and conduit 34*b* generally define inner loop 32. Inner loop 32 includes a fluid within conduit 34*i* and 34*b* and a heat exchanger 44. In the depicted embodiment, heat exchanger 44 allows heat energy to be transferred between the engine exhaust 16 and the fluid within inner loop 32. Heat exchanger 44 may be any suitable type of heat exchanger.

Valve 36 may be any suitable type of valve configure to control the flow of fluid. In the depicted embodiment, valve 36 connects outer loop 30 to inner loop 32, and valve 36 also controls the amount of fluid that flows from inner loop 32 into outer loop 30. Thus, if valve 36 is closed, substantially no fluid will flow from inner loop 32 into outer loop 30. Conversely, if valve 36 is opened, fluid will flow from inner loop 32 into outer loop 30.

In the depicted embodiment, second loop 22 includes fluid flowing through a conduit 50, a heat exchanger 52, a pump 54, a condenser 56 and a turbine 58. The fluid utilized in the depicted embodiment may be any suitable fluid. For example, the fluid may be any organic fluid. In embodiments of the invention, the organic fluid may be butane or pentane.

The heat exchanger 52 may be any suitable heat exchanger, and pump 54 may be any suitable pump capable of propelling the fluid through the conduit 50. Heat exchanger 52 is configured to transfer heat energy from the exhaust gas recirculation system 14 into the fluid flowing through the conduit 50. Condenser 56 may be any suitable condenser capable of condensing the fluid flowing through the conduit 50 from a gas state into a liquid state. Turbine 58 may be any suitable turbine capable of converting heat energy of the fluid into electrical energy.

Heat exchanger 24 may be any suitable heat exchanger. In the depicted embodiment, heat exchanger 24 is configured to transfer heat energy between conduit 34 of first loop 20 and conduit 50 of the second loop 22.

In operation, second loop 22 functions as a Rankine cycle in order to utilize turbine 58 to generate electricity. Specifically, as the fluid of second loop 22 enters pump 54, the fluid is in the liquid state. Pump 54 will propel the fluid through conduit 50 toward heat exchanger 52. In the depicted embodiment, heat exchanger 52 is configured to transfer heat from the exhaust gas recirculation system 14 into the fluid flowing through conduit 50. Generally, the temperature of the gas in the exhaust gas recirculation system 14 is greater than the temperature of the fluid flowing through conduit 50, and accordingly, the temperature of the fluid within the conduit 50 will increase.

After the fluid within conduit 50 exits heat exchanger 52, the fluid travels to heat exchanger 24. Heat exchanger 24 is configured to transfer heat from the fluid traveling through the conduit 34 to the fluid traveling within the conduit 50.

In the depicted embodiment of first loop 20, pump 42 is configured to propel the fluid within conduit 34 through the loop 20. As pump 42 propels the fluid through outer loop 30, the fluid passes through heat exchanger 40. Heat exchanger 40 is in thermal contact with exhaust gas recirculation system 14, and heat exchanger 40 transfers heat from the exhaust gas recirculation system 14 into the fluid flowing through conduit 34. The fluid will continue to flow within outer loop 30 and enter heat exchanger 24. Heat exchanger 24 transfers heat energy from the fluid flowing through conduit 34 into the fluid flowing through conduit 50.

It should be noted that when the exhaust gas recirculation system 14 is in a high flow state, with the recirculated exhaust gases flowing at a high speed, heat exchanger 40 will generally maximize the amount of heat transferred into the fluid flowing through conduit 34. Accordingly, the fluid within conduit 34 will transfer a maximum amount of heat through heat exchanger 24 into the fluid within conduit 50, thereby maximizing the temperature of the fluid within conduit 50. With the fluid within conduit 50 at a maximum temperature, turbine 58 will produce a maximum amount of electricity as the fluid flows therethrough.

In certain instances, the engine 12 will be at a lower flow condition, and accordingly, the exhaust gas recirculation system 14 may be at a relatively lower flow condition. When exhaust gas recirculation system 14 is in a relatively lower flow state, less heat is transferred into the fluid within the conduit 50 through the heat exchangers 40 and 52. Accordingly, the fluid within conduit 50 entering the turbine 58 may be at a relatively lower temperature and therefore turbine 58 may produce less electrical energy. In situations such as this, valve 36 may be opened in order to allow fluid to flow through inner loop 32. Specifically, a portion of the fluid flowing through conduit 34*b* will enter inner loop 32 at junction 60. The fluid entering inner loop 32 passes through heat exchanger 44 which is thermally connected to the exhaust system 16. Accordingly, heat exchanger 44 will transfer heat energy from the exhaust system 16 into the fluid traveling through inner loop 32. The fluid within inner loop 32 then flows back into outer loop 30 at the junction formed by valve 36. Due to the heat received at heat exchanger 44, the fluid in inner loop 32 is at a higher temperature than the fluid present within outer loop 30 proximate valve 36. Accordingly, the fluid from inner loop 32 will warm the fluid in the outer loop 30 at that point.

In this manner, when the exhaust gas recirculation system 14 is in a lower flow state, the heat from the exhaust system 16 may be utilized to increase the temperature of the fluid flowing through conduit 34. Moreover, the degree to which valve 36 is opened may correspond inversely to the flow rate of the gas within the exhaust gas recirculation system 14. Specifically, the lower the flow of gas within the exhaust gas recirculation system 14, the more that valve 36 may be opened in order to increase fluid flow through the inner loop 32 and ensure the fluid within loop 20 reaches a desired temperature. The increase in the temperature of the fluid within conduit 34 will allow additional heat to be transferred through heat exchanger 24 and into the fluid within conduit 50. With this arrangement, one can ensure that the fluid within conduit 50 enters the turbine 58 at substantially the maximum desired temperature.

It should be noted that the heat energy of the gas within the exhaust system 16 may also be utilized in the heating of the fluid within conduit 50 in instances wherein the engine 12 is at a relatively cooler temperature, such as upon an initial start, for example. Specifically, when engine 12 is first started on a cold day, in general, the temperature of the gas flowing through both the exhaust system 16 and the exhaust gas recirculation system 14 may be at a temperature lower than nominal. Accordingly, heat energy from both the exhaust system 16 and the exhaust gas recirculation system 14 may be necessary to heat the fluid flowing through conduit 50.

In embodiments of the invention, temperature sensors may be placed within the two loops 20, 22 in order to measure the temperature of the fluid flowing in the loops 20, 22. The sensors may be connected to a controller configured, in part, to control the valve 36. When the controller determines that the temperature of the fluid as it flows into turbine 58 is below a desired value, the controller may open valve 36 in order to increase the temperature of the fluid flowing through loop 20 by gathering heat energy from the gases of the exhaust system 16. If the exhaust gas recirculation system 14 were to increase in flow thereby increasing the temperature of the fluids within the loops 20, 22, the controller may sense this temperature increase via the sensors and begin to close valve 36 in order to reduce the flow of fluid through inner loop 32. The decreases in the amount of fluid flowing through inner loop 32 will decrease the amount of heat energy the fluid absorbs from the exhaust system 16.

Figure 2:
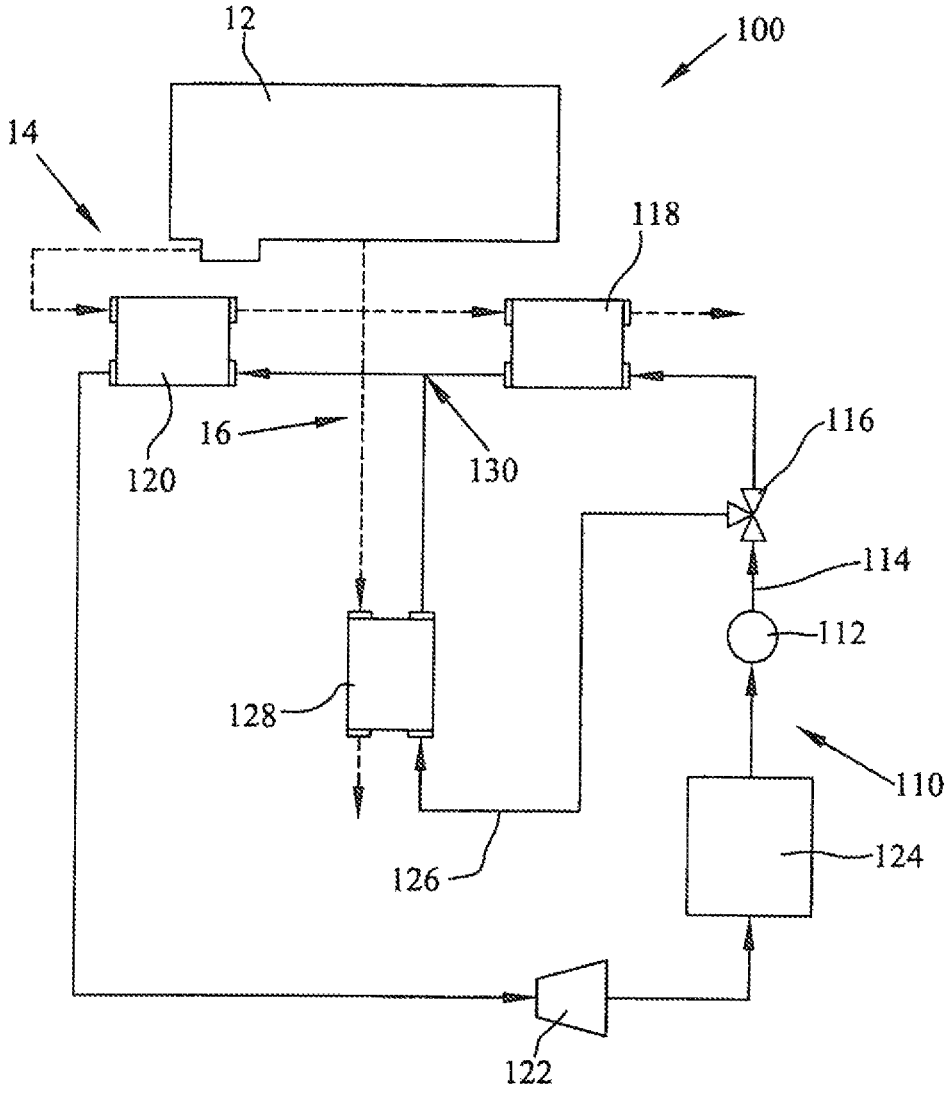
FIG. 2 depicts a general schematic diagram of portions of another exemplary waste heat recovery system embodying principles of the present invention.

FIG. 2 depicts an additional embodiment of the present invention comprising a waste heat recovery system generally indicated by numeral 100. In the depicted embodiment, waste heat recovery system 100 includes an engine 12 and a loop 110. Similar to that described above, engine 12 includes an exhaust gas recirculation system, generally indicated by numeral 14, and an exhaust system, generally indicated by numeral 16.

Loop 110 includes a pump 112, conduit 114, a three-way valve 116, a first heat exchanger 118, a second heat exchanger 120, a turbine 122, a condenser 124, conduit 126, a third heat exchanger 128 and a fluid flowing through the conduit (not shown). In the depicted embodiment, heat exchanger 118 and heat exchanger 120 are configured to transfer heat energy from the exhaust gas recirculation system 14 into the fluid flowing through conduit 114 in a manner similar to that described above, with respect to the heat exchangers 40, 52 depicted in FIG. 1. In addition, heat exchanger 128 is configured to transfer heat energy from the exhaust system 16 into the fluid flowing through conduit 126 in a manner similar to that described above with respect to heat exchanger 44 depicted in FIG. 1.

In operation, when the EGR system 14 is generating maximum heat, pump 112 drives the fluid flowing within conduit 114 into three-way valve 116. With the exhaust gas recirculation system 14 providing maximum energy at high flow, three-way valve 116 directs substantially all of the fluid flowing through conduit 114 into the heat exchanger 118. As the fluid passes through the heat exchanger 118, the fluid is heated by the gas flowing through the exhaust gas recirculation system 14. Upon exiting the heat exchanger 118, the fluid then flows into heat exchanger 120 wherein the fluid may be further heated by the heat transferred from the gas flowing in the exhaust gas recirculation system 14. From heat exchanger 120, the super heated fluid flows into turbine 122. Turbine 122 may then convert a portion of the heat energy of the fluid into electrical energy. The fluid then flows into condenser 124 in order to be condensed into a liquid, and the fluid then returns to pump 112 to again be driven toward three-way valve 116.

When the exhaust gases flowing within the exhaust gas recirculation system 14 are flowing at a less than maximum rate, it may be necessary to utilize heat present within the exhaust gases of the engine exhaust system 16 in order to ensure that the fluid entering turbine 122 is at a proper temperature. Accordingly, when the exhaust gas recirculation system 14 is not capable of providing enough heat to the fluid, three-way valve 116 may direct a portion of the fluid flowing through conduit 114 into conduit 126. The fluid flowing through conduit 126 passes through heat exchanger 128 thereby allowing heat from the gas of the engine exhaust system 16 to be passed to the fluid. The heated fluid exiting heat exchanger 128 then joins with the heated fluid exiting heat exchanger 118 at junction 130. This combined fluid may then pass into the exchanger 120 in order to receive additional heat from the gas of the exhaust gas recirculation system 14, at which time the heated fluid will pass into the turbine 122 to generate electricity.

The depicted system 100 may include a variety of temperature sensors and other sensors, in addition to automatic control mechanisms coupled to the valve 116, in order to allow the valve 116 to automatically adjust the amount of fluid that will flow from pump 112 into heat exchanger 128. For example, when the sensors detect that the fluid entering turbine 122 is at too low of a temperature, sensors may command valve 116 to direct additional fluid through the conduit 126 and into heat exchanger 128 in order to utilize heat from the engine exhaust system 16. Conversely, as the sensors detect fluid at an excess temperature entering turbine 122, the control system may direct valve 116 to reduce the amount of fluid flowing through conduit 126 and into heat exchanger 128.

Figure 3:
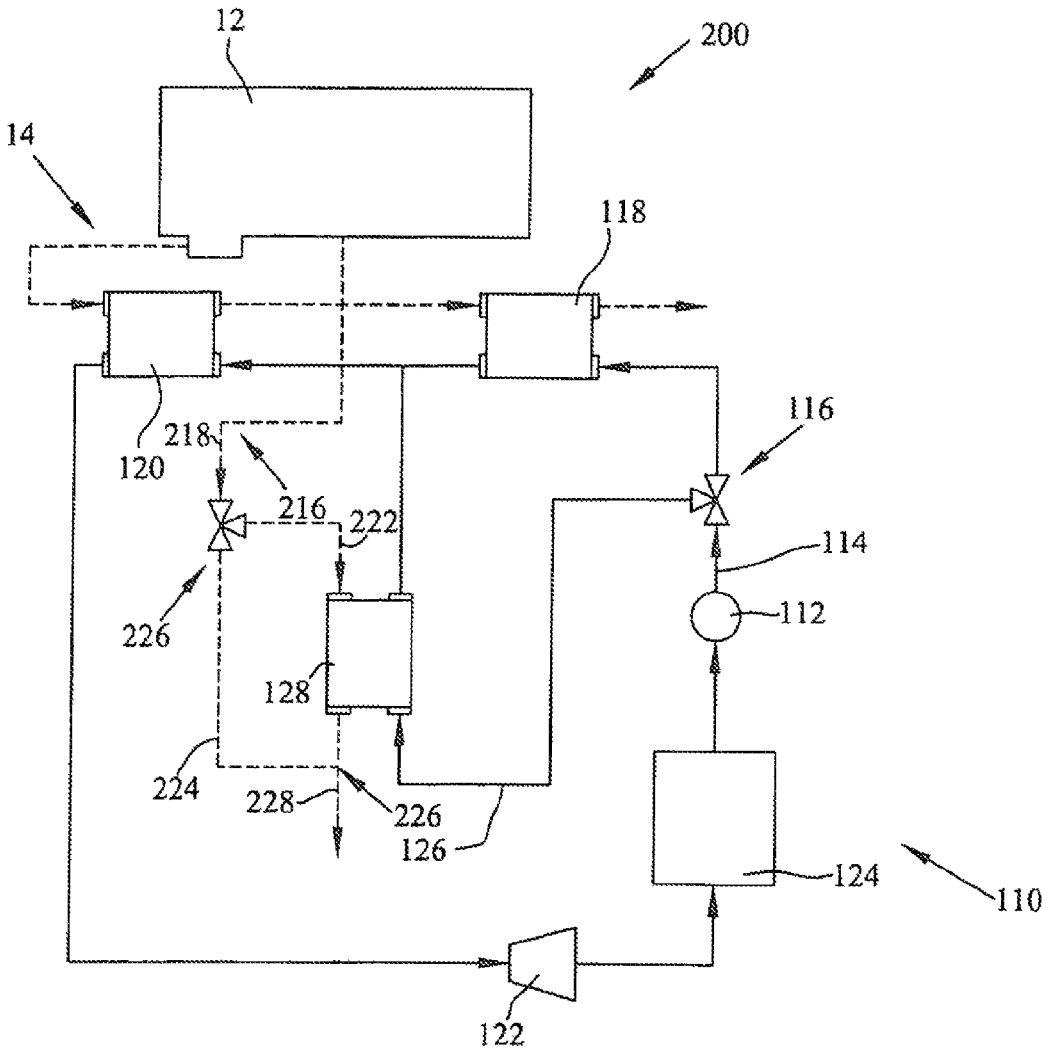
FIG. 3 depicts a general schematic diagram of portions of another exemplary waste heat recovery system embodying principles of the present invention.

FIG. 3 depicts another embodiment of the present invention. In the depicted embodiment, system 200 includes an engine 112, an exhaust gas recirculation system, indicated by numeral 14, and engine exhaust system, indicated by the numeral 216. In addition, system 200 a loop, generally indicated by numeral 110. It should be noted that in the depicted embodiment, the loop 110 functions in a manner substantially similar to the loop 110 depicted in FIG. 2 and described above.

In the depicted embodiment of the invention, engine exhaust 216 includes a conduit 218 through which the majority of the engine exhaust gas flows. From conduit 218 the engine exhaust gas flows into a three-way valve 220. Valve 220 may direct a portion of the engine exhaust gas into conduit 222 or conduit 224. The portion of gas that flows within conduit 222 passes through heat exchanger 128, so that the heat energy of the gas may be transferred into the fluid flowing through conduit 126. The portion of the exhaust gas flowing through conduit 224, however, bypasses the heat exchanger 128. Thus, heat energy of the gas flowing through conduit 224 is not transferred into the fluid flowing through loop 110. The exhaust gas flowing through the conduits 222, 224 joins together at junction 216, and the gas then exits the vehicle by way of conduit 228.

The depicted embodiment of the invention allows the system 200 to better control the amount of heat from the engine exhaust 216 that is passed to the fluid flowing through loop 110 by way of heat exchanger 128. Specifically, three-way valve 220 will only allow a desired amount of engine exhaust gas to flow through conduit 222, as necessary. For example, in a situation where the exhaust gas recirculation system 14 is at maximum flow and no heat energy is necessary from the engine exhaust 216, three-way valve 220 may direct all of the gas flowing through the engine exhaust 216 into conduit 224 and prevent any gas from entering conduit 222. This allows all the gas to bypass the heat exchanger 128 and, therefore, prevents heat transfer into stagnant fluid present within the heat exchanger 128. As the exhaust gas recirculation system 14 tends to slow down and heat is required from the engine exhaust 216, three-way valve 220 may then direct exhaust gas into conduit 222 in order to allow heat to transfer from the conduit 222 into the fluid flowing through heat exchanger 128.

It should be noted that in the depicted embodiment, sensors and control mechanisms (not shown) may be utilized to monitor and control the amount of heat transferred into the fluid of loop 110 by heat exchanger 128.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method for recovering heat using waste heat from an engine including an exhaust system and an exhaust gas recirculation system comprising:

transferring heat energy, using a first heat exchanger, from the exhaust gas recirculation system to a liquid flowing through a conduit defining a loop;

transferring heat energy using a second heat exchanger, from the exhaust system to the liquid of the loop;

combining the liquid heated by the exhaust system with the heated liquid flowing from said first heat exchanger at a junction in the loop; and transferring heat energy, using a third heat exchanger positioned downstream of said junction, from the exhaust gas recirculation system to the combined liquid heated by the exhaust system and by the exhaust gas recirculation system.

2. The method for recovering heat using waste heat as set forth in claim 1 wherein the amount of heat energy transferred into the loop from the exhaust system increases as the amount of energy transferred into the loop from the exhaust gas recirculation system decreases.

3. The method for recovering heat using waste heat as set forth in claim 1 wherein the amount of heat energy transferred into the loop from the exhaust system decreases as the engine heats up.

4. The method for recovering heat using waste heat as set forth in claim 1 wherein the exhaust gas recirculation system is in at least a high flow state and a low flow state and greater heat energy is transferred from the exhaust system into the loop when the exhaust gas recirculation system is in the low flow state than when the exhaust gas recirculation system is in the high flow state.

5. The method for recovering heat using waste heat as set forth in claim 1 wherein less heat energy is transferred into the liquid of the loop from the exhaust system as the engine warms.

6. The method for recovering heat using waste heat as set forth in claim 1 further including directing the liquid in the loop into a heat conversion device.

7. A system configured to recover heat from waste heat produced by an engine including:

an exhaust gas recirculation system;

and an exhaust system; and a loop including a conduit, fluid flowing through the conduit, a first heat exchanger to transfer heat energy from the exhaust gas recirculation system into the fluid, a second heat exchanger positioned downstream of said first heat exchanger to transfer heat energy from the exhaust gas recirculation system to the fluid in the loop, a third heat exchanger adapted to transfer heat from the exhaust system into the fluid, a junction positioned upstream of said second heat exchanger and downstream of said first heat exchanger to combine heated fluid flowing from said third heat exchanger with fluid flowing from said first heat exchanger prior to flowing into said second heat exchanger.

8. The system as set forth in claim 7 wherein the loop further includes a valve configured to control the flow of the fluid, the valve being configured to selectively direct a portion of the fluid to the third heat exchanger when the temperature of the fluid drops below a set point.

9. The system as set forth in claim 7 wherein the exhaust system includes a valve configured to allow exhaust gas to bypass the third heat exchanger.

10. The system as set forth in claim 7 wherein the loop further includes a pump configured to propel the fluid and a heat conversion device.

* * * * *